US005383342A

United States Patent [19]

El-Boher et al.

[11] Patent Number: 5,383,342

[45] Date of Patent: Jan. 24, 1995

[54] METHOD AND INSTALLATION FOR CONTINUOUS PRODUCTION OF LIQUID ICE

[75] Inventors: Arie El-Boher, Metar; Michael Z. Pechatnikov, Beer-Sheva; Boris M. Menin, Ofakim; Semion M. Novak, Kiryat Yam; Uri Kabiri, Givatayim, all of Israel

[73] Assignee: Ontec Ltd., Beer-Sheva, Israel

[21] Appl. No.: 60,777

[22] Filed: May 11, 1993

[30] Foreign Application Priority Data

May 14, 1992 [IL] Israel ..... 101862

[51] Int. Cl.[6] ..... B01D 9/04

[52] U.S. Cl. ..... 62/532; 62/3.1; 62/123

[58] Field of Search ..... 62/123, 532, 538, 539, 62/3.1

[56] References Cited

U.S. PATENT DOCUMENTS

| | | | |
|---|---|---|---|
| 4,170,881 | 10/1979 | Lang et al. | 62/538 |
| 4,405,349 | 9/1983 | Mukherjee | 62/532 |
| 4,750,333 | 6/1988 | Husain et al. | 62/532 |
| 4,936,114 | 6/1990 | Engdahl et al. | 62/532 |

*Primary Examiner*—Ronald C. Capossela
*Attorney, Agent, or Firm*—McAulay Fisher Nissen Goldberg & Kiel

[57] ABSTRACT

An installation for continuous production of liquid ice from a solution, including a circulation tank, a pump, a refrigeration circuit for cooling solution passing through at least one tubular element, causing the formation therein of ice crystal nuclei and small pure ice crystals, a liquid separator-regenerative heat exchanger, a crystal growth vessel into which the cooled solution containing ice crystal nuclei and small ice crystals is discharged, and an ice separator fed from the ice crystal growth vessel, in which pure ice crystals are separated from concentrated solution which is returned to the circulation tank, the pure ice crystals being continuously discharged from the ice separator. A method for continuous production of liquid ice is also described.

23 Claims, 10 Drawing Sheets

METHOD AND INSTALLATION FOR CONTINUOUS PRODUCTION OF LIQUID ICE

The present invention relates to a method and an installation for the continuous production of liquid ice.

An ice-making machine and method is known from U.S. Pat. No. 4,551,159 in which a solution mixture in a container is continuously cooled by a refrigerant surrounding that container. Wall surfaces of this container are continuously scoured by scrapers at a rate fast enough to prevent formation of an ice layer on the container wall. Ice crystals grow throughout the container and are continuously discharged from the container, water being continuously added to maintain a predetermined solution concentration.

The method according to the above patent is, however, hardly workable or at least highly inefficient because of the excessively high heat flow value employed, which is at least 4000 BTU per square foot per hour (12.6 kW/m$^2$). Not only is this method wasteful of energy, but the ice obtained is impure, as the above heat flow produces an ice layer growth rate in excess of 0.07 m/h. At such rates, the speed at which solid particles—always present in brine or other low freezing point solutions—can migrate to the surface of a nascent ice crystal becomes equal to the freezing rate and these particles therefore have no time to be squeezed out by the crystallizing water and are thus trapped inside the ice crystal formed, producing "dirty" ice. The prior art method and installation also fails to teach such important components of the solution and refrigerant circuits as important components of the solution and refrigerant circuits as a heat exchanger for the precooling of the solution and a liquid separator-heat exchanger which protects the refrigeration compressor by supplying only dry refrigerant vapors, while returning the precipitated liquid refrigerant to the evaporator and, at the same time, as heat exchanger, heating the vapor and cooling the liquid refrigerant upstream of the expansion valve.

A further serious disadvantage of the above prior art resides in the fact that, in order for the installation to function reliably, the temperature of the solution layer at the cooled wall surface must not be below the freezing point of water in the solution by more than 1° C., and the temperature of the entire cooled solution volume must not be more than 0.2° C. below that point. These conditions require a tight control of such divers parameters as solution concentration, heat flow, uniformity of thermal resistance, heat transfer film coefficients, and more, which, under field conditions (as opposed to laboratory conditions), are almost impossible to maintain at economically defensible costs.

It is one of the objects of the present invention to overcome the drawbacks and disadvantages of the prior art and to provide a method and an installation for the continuous production of liquid ice which consumes less energy while producing pure ice crystals free of solid inclusions, is less demanding as to the close adherence to predetermined parameters and optimizes, as well as maintains, at little extra expenditure, all essential operational parameters.

According to the invention, this is achieved by providing a method for continuous production of liquid ice, comprising the steps of providing a solution of a predetermined concentration, having a below-zero cryoscopic temperature; withdrawing said solution from a circulation tank and passing it through at least one tubular element, the outer wall surface of which is in direct thermal contact with a boiling refrigerant in an evaporator-crystallizer, heat exchange with which refrigerant, across the wall of said tubular element, causes the solution layer adjacent to the inside surface of said tubular element to cool down and to produce ice crystal nuclei adhering to said inside surface; leading liquid particles-containing refrigerant vapor produced by said boiling refrigerant from said evaporator-crystallizer to a liquid separator and returning the liquid refrigerant thus separated to said evaporator-crystallizer; applying means to remove said ice crystal nuclei from said inside surface and to distribute them as well as said wall-adjacent cooled-down solution layer substantially uniformly throughout the entire volume of said tubular element to promote formation of ice crystal nuclei and of small, pure ice crystals throughout said volume; removing said nuclei and said pure ice crystals together with concentrated solution from said tubular element; separating said ice crystals from said concentrated solution, and returning said concentrated solution to said circulation tank and restoring the concentration thereof to its predetermined value.

The invention further provides a method for continuous production of liquid ice, comprising the steps of providing a solution of a predetermined concentration, having a below-zero cryoscopic temperature; providing means for generating at least one magnetic field; withdrawing said solution from a circulation tank; leading said solution through said at least one magnetic field; passing said solution, acted upon by said magnetic field, through at least one tubular element, the outer wall surface of which is in direct contact with a boiling refrigerant in an evaporator-crystallizer, heat exchange with which refrigerant, across the wall of said tubular element, causes the solution layer adjacent to the inside surface of said tubular element to produce ice crystal nuclei adhering to said inside surface; applying means to remove said ice crystal nuclei from said inside surface and to distribute them, as well as said wall-adjacent, cooled-down solution layer, substantially uniformly throughout the entire volume of said tubular element to promote formation of ice crystal nuclei and of small, pure ice crystals throughout said volume; removing said nuclei and said pure ice crystals together with concentrated solution from said tubular element; separating said ice crystals from said concentrated solution, and returning said concentrated solution to said circulation tank and restoring the concentration thereof to its predetermined value.

In addition, the invention provides an installation for continuous production of liquid ice from a solution, comprising a circulation tank for supplying solution of a predetermined concentration and receiving solution at a different concentration, to be made up to said predetermined concentration; pump means for propelling solution from said circulation tank into at least one tubular element in heat-conductive contact, in an evaporator-crystallizer, with a boiling refrigerant; a refrigeration circuit for cooling solution passing through said at least one tubular element, causing the formation therein of ice crystal nuclei and small pure ice crystals; a liquid separator-regenerative heat exchanger mounted above said evaporator-crystallizer; conduit means interconnecting said liquid separator and said evaporator-crystallizer; a crystal growth vessel into which said cooled solution containing ice crystal nuclei and small ice crystals is discharged via a conduit, in which vessel ice crystals of utilizable size are created adiabatically by the elimination of small particles and from which vessel any crystal-free, concentrated solution is led back via another conduit to said circulation tank, and an ice separator fed from said ice crystal growth vessel, in which pure ice crystals are separated from concentrated solution which is returned to said circulation tank via a further conduit, said pure ice crystals being continuously discharged from said ice separator.

The invention still further provides an installation for continuous production of liquid ice from a solution, comprising a circulation tank for supplying solution of a predetermined concentration and receiving solution at a different concentration, to be made up to said predetermined concentration; pump means for propelling solution from said circulation tank into at least one tubular element in heat-conductive contact, in an evaporator-crystallizer, with a boiling refrigerant; a heat exchanger located downstream of said pump means and upstream of said at least one tubular element, in which heat exchanger said solution is precooled by giving up heat to said refrigerant before being introduced into said at least one tubular element: a refrigeration circuit for cooling solution passing through said at least one tubular element, causing the formation therein of ice crystal nuclei and small pure ice crystals; a liquid separator-regenerative heat exchanger mounted above said evaporator-crystallizer and serving to superheat the refrigerant vapor produced by the boiling-off liquid refrigerant in said evaporator-crystallizer, and to subcool said liquid refrigerant, further serving to separate the mixture of liquid and vaporous refrigerant exiting from said precooling heat exchanger to provide dry vaporous refrigerant for said refrigerant circuit; conduit means interconnecting said liquid separator and said evaporator-crystallizer to return said separated liquid refrigerant to said evaporator-crystallizer; a crystal growth vessel into which said cooled solution containing ice crystal nuclei and small ice crystals is discharged via a conduit, in which vessel ice crystals of utilizable size are created adiabatically by the elimination of small particles and from which vessel any crystal-free, concentrated solution is led back via another conduit to said circulation tank, and an ice separator fed from said ice crystal growth vessel, in which pure ice crystals are separated from concentrated solution which is returned to said circulation tank via a further conduit, said pure ice crystals being continuously discharged from said ice separator.

To facilitate understanding of the following, it will be appreciated that the method and installation according to the invention use different working fluids which, in the description below, are given the following designations, which apply also to the conduits carrying these fluids:

| | |
|---|---|
| Water | W |
| Solution at a predetermined concentration | B |
| Solution, concentrated | $B_C$ |
| Refrigerant, liquid | $R_L$ |
| Refrigerant, vaporous | $R_V$ |
| Mixture of $R_L$ and $R_V$ | $R_{L+V}$ |
| Liquid ice | I |
| Mixture of $B_C$ and I | $B_C + I$ |

It should be further noted that the term "solution" as used herein, refers to a low freezing point liquid in which the solvent is water and the solute any substance suitable for the intended purpose. In the method according to the invention, the solute may advantageously be common salt, forming with water a solution commonly known as "brine". Another possibility would be a solution based on glycol.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Figure 3:
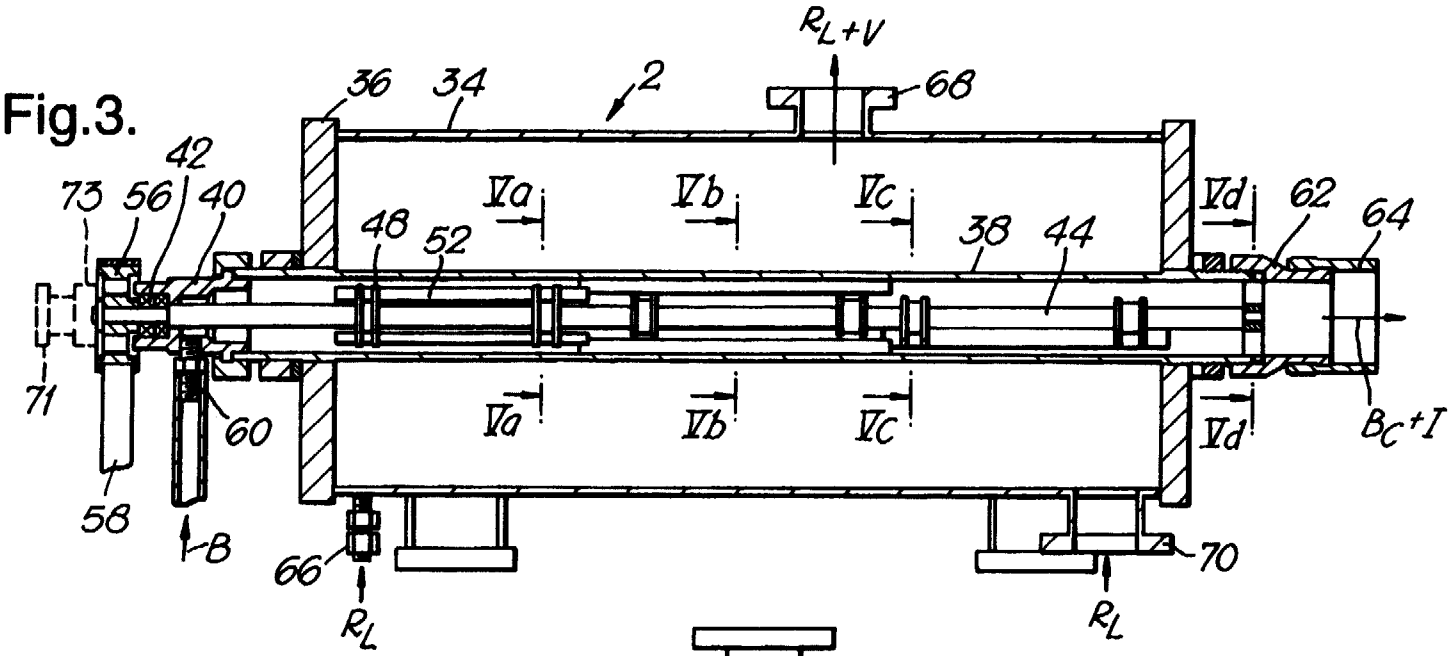
FIG. 3 is a longitudinal cross-sectional view of a first embodiment of the evaporator-crystallizer of the installation according to the invention.
Figure 6:
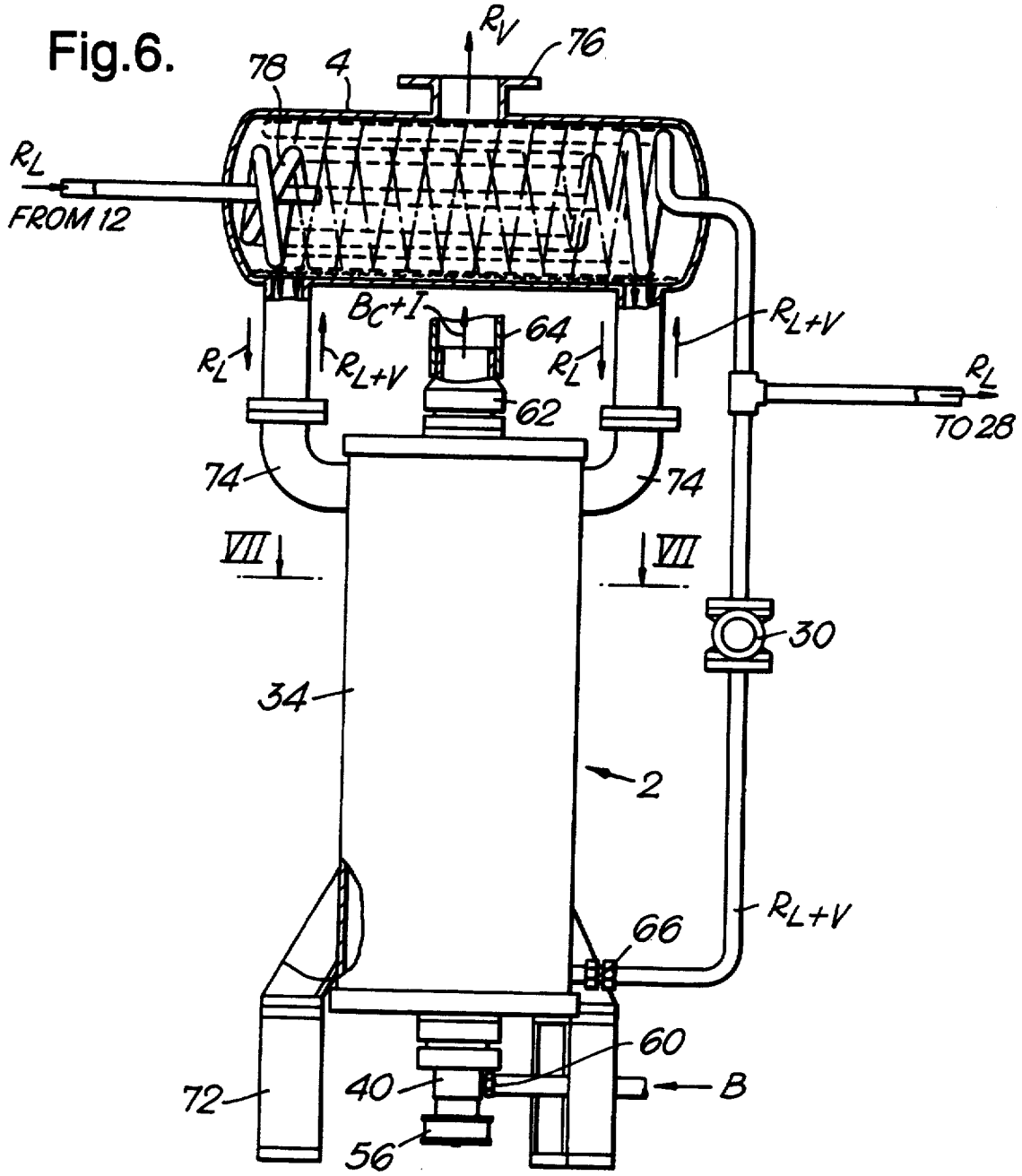
Figure 7:
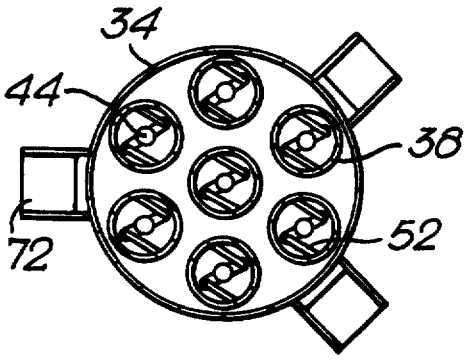
Figure 8:
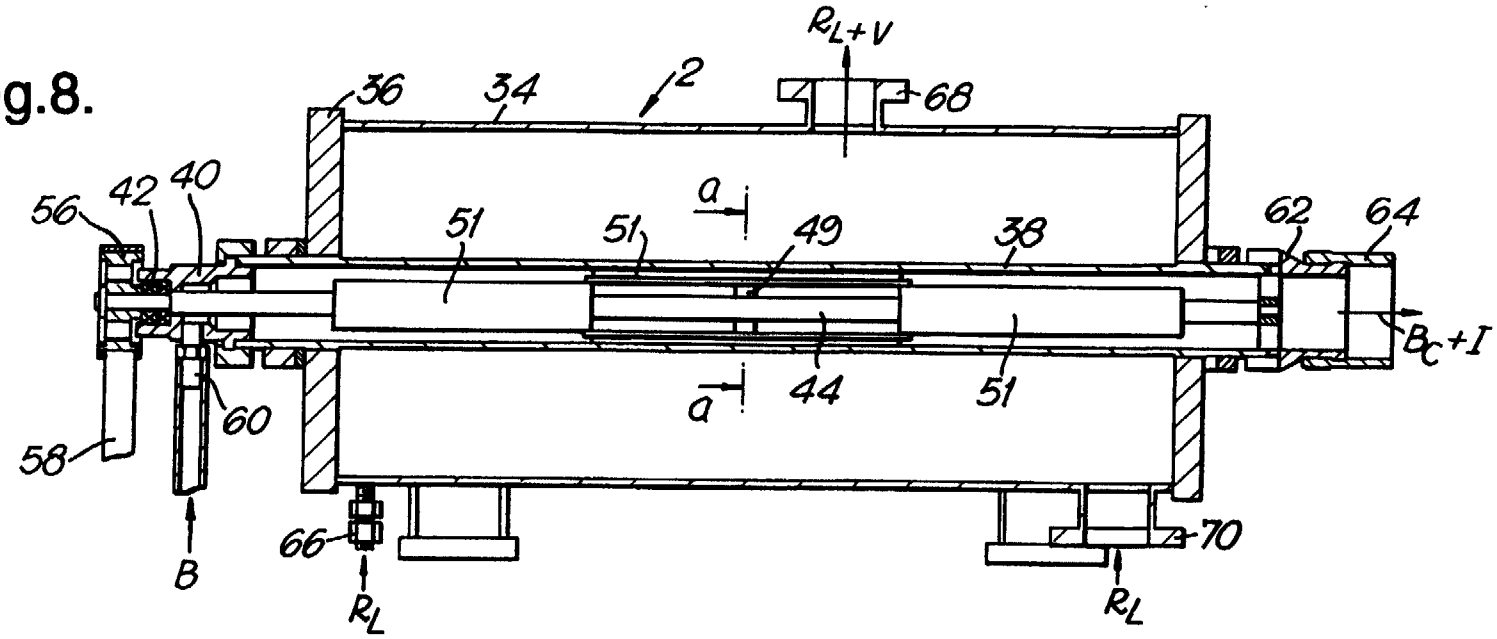
Figure 8A:
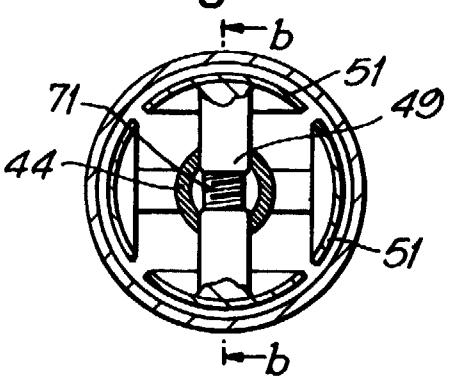
Figure 8B:
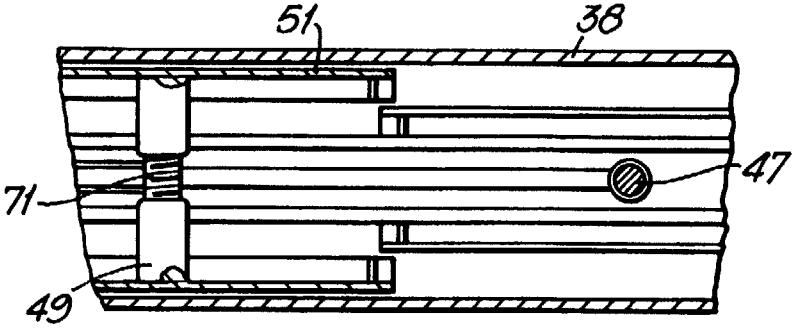
Figure 10:
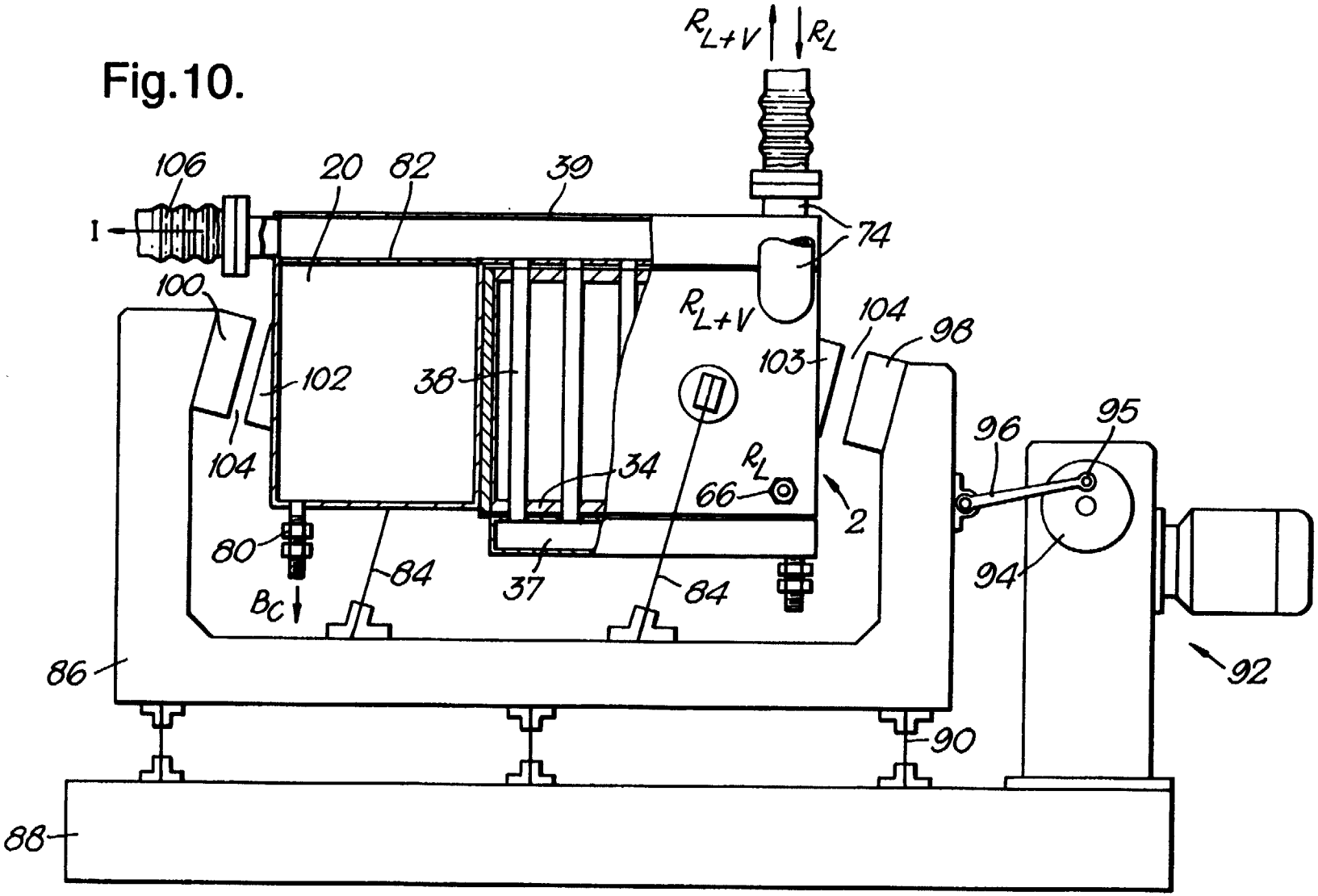
Figure 11:
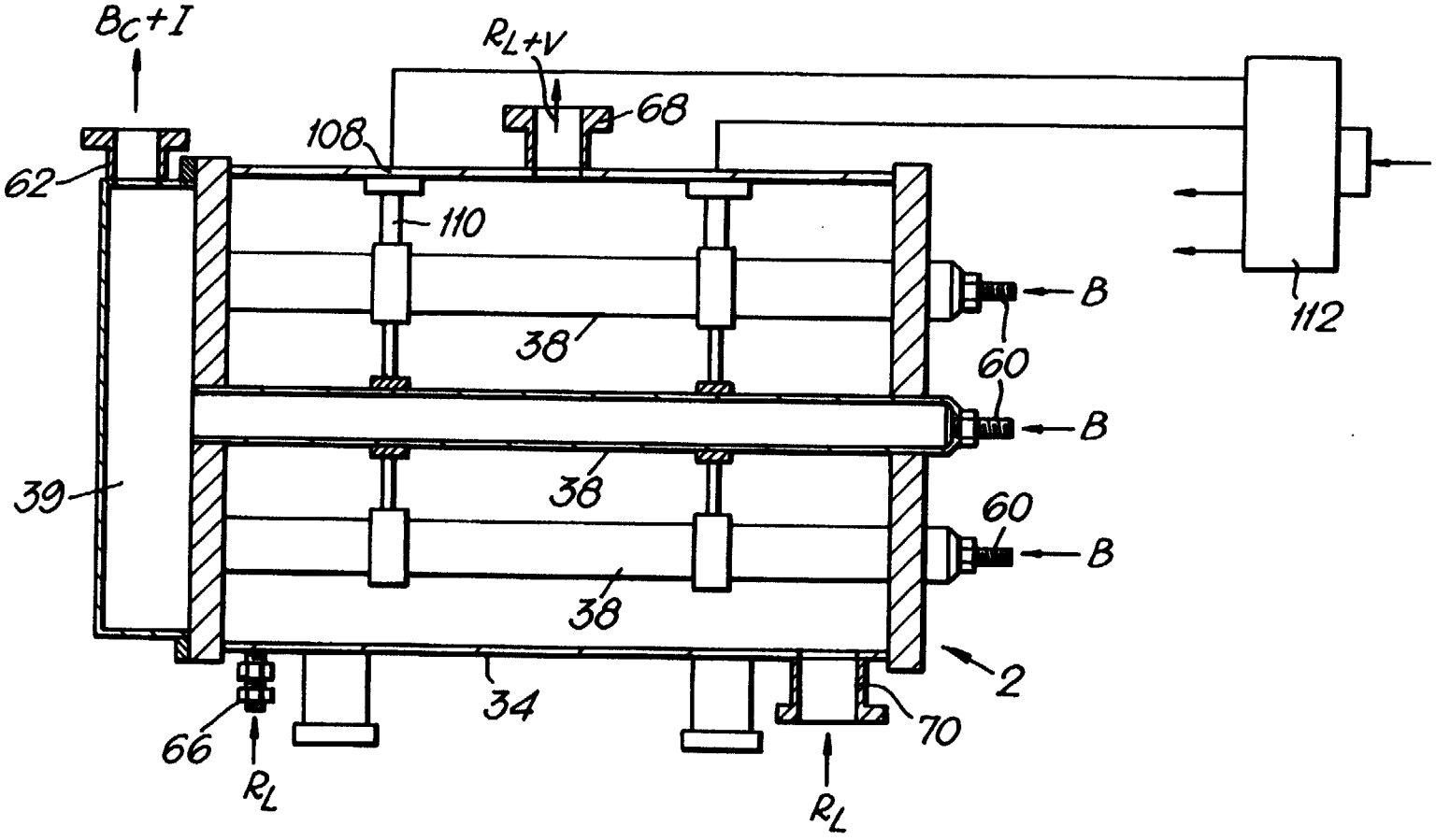

FIGS. 5*a–d* represent views, in cross section along the corresponding planes in FIG. 3, of one of the tubular elements of the embodiment of FIG. 3;

FIG. 6 shows an evaporator-crystallizer embodiment of the vertical type, with a horizontal liquid separator-regenerative heat exchanger;

FIG. 7 is a view, in cross section along plane VII—VII in FIG. 6, of the embodiment of FIG. 6;

FIGS. 8, 8*a* and 8*b* represent cross-sectional views of a further embodiment of the evaporator-crystallizer of the installation according to the invention;

FIGS. 9, 9*a–c* illustrate a further embodiment of the evaporator-cyrstalliser according to the invention;

FIG. 10 schematically represents a vibratory embodiment of the evaporator-crystallizer according to the invention;

FIG. 11 shows an embodiment in which the tubular elements are vibrated, and

Figure 12:
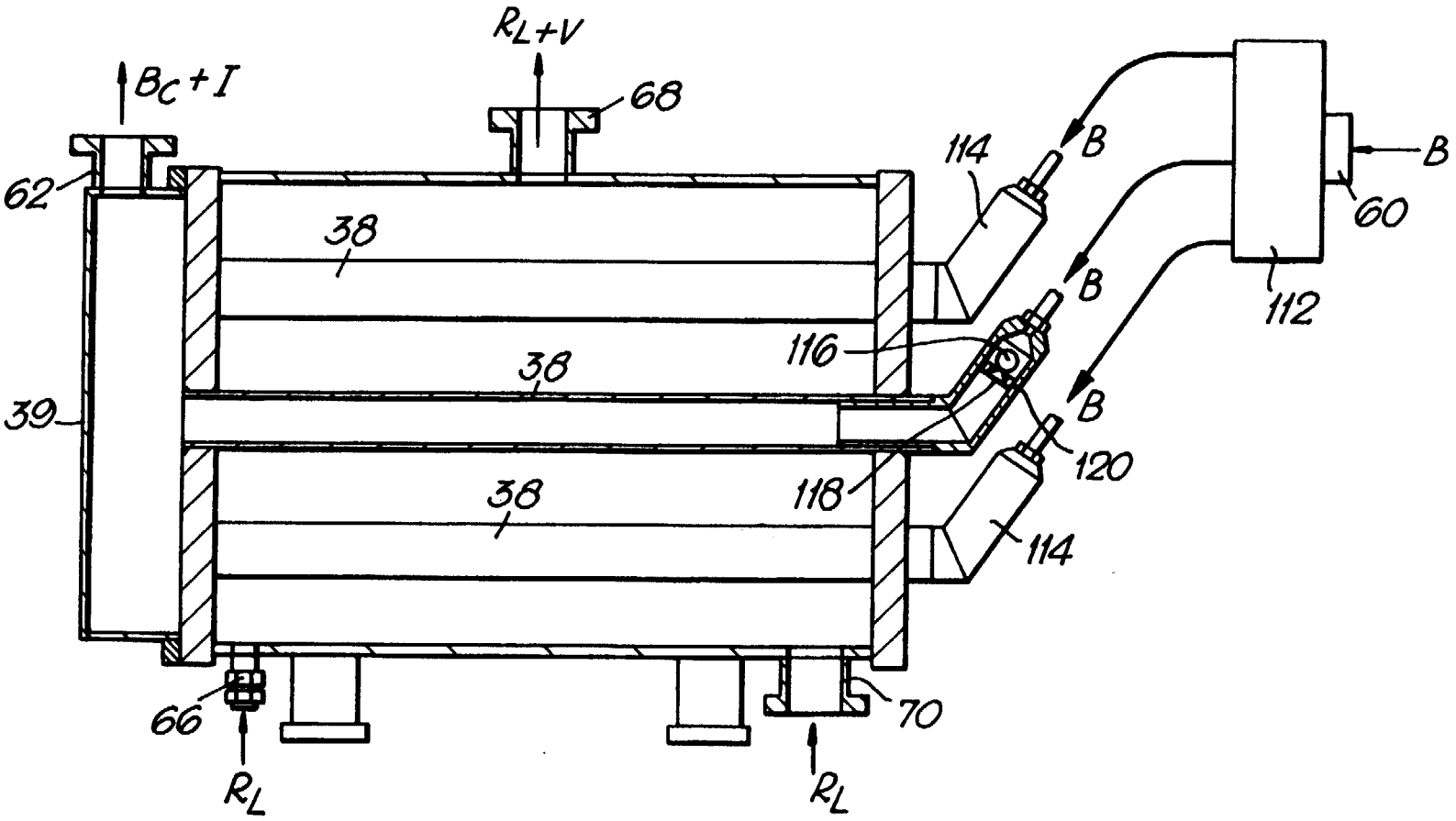

FIG. 12 is a cross-sectional view of yet another hydraulically vibrated evaporator-crystallizer.

Figure 1:
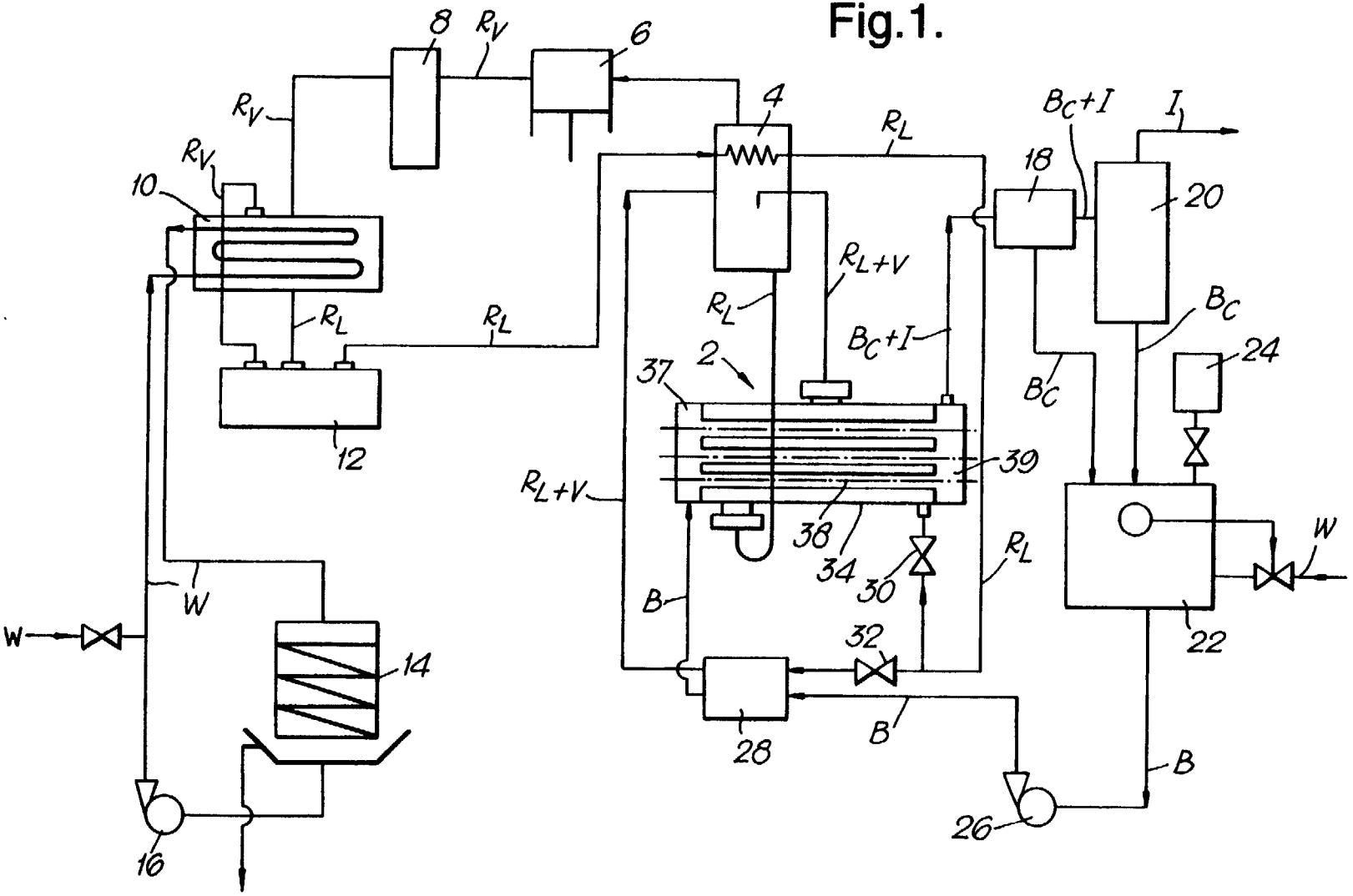
FIG. 1 is a general layout and flow diagram of a first embodiment of the installation according to the invention.

Referring now to the drawings, there are seen in the schematic layout of FIG. 1 an evaporator-crystallizer 2 comprised of housing 34, tubular elements 38, an inlet manifold 37 and an outlet manifold 39 for the elements 38, a liquid separator-regenerative heat exchanger 4 located above the vessel 2, a compressor 6, an oil separator 8, a condenser 10 in which the refrigerant vapor $R_V$ is returned to the liquid state $R_L$, a receiver vessel 12 from which the liquid refrigerant $R_L$ is supplied to the evaporator-crystallizer, a cooling tower 14 for cooling the water W circulated through the condenser 10 by the pump 16, a crystal-growth vessel 18 where the growth of pure ice crystals I is facilitated, an ice separator 20, advantageously in the form of a washing tower in which the ice crystals I are separated from the now concentrated solution, e.g., brine (see below) which is then transferred to the circulation tank 22 in which solution concentration, if too high, is adjusted by addition of water, and if too low, by the addition of concentrated solution $B_C$ from the concentration-maintaining vessel 24. The solution B is circulated by a pump 26. In order to keep the solution at a temperature close to its cryoscopic point, it is advantageous to pre-cool it, prior to its introduction into the evaporator-crystallizer 2, in a heat exchanger 28 where it loses heat to the refrigerant $R_L$. Also seen are a first expansion valve 30 upstream of the evaporator-crystallizer 2 and a second expansion valve 32 upstream of the heat exchanger 28.

The installation according to the invention as schematically illustrated in FIG. 1 is seen to comprise two separate, but thermally interacting, circuits, a solution circuit and a refrigerant circuit (apart from the above-mentioned cooling-water circuit that serves as a heat sink for the condenser 10).

The solution circuit includes the circulation tank 22, the pump 26, the heat exchanger 28, the tubular elements 38 and their inlet and outlet manifolds 37 and 39, the crystal growth vessel 18 in which crystals of utilizable size are created adiabatically by elimination of small particles, and the ice separator 20, from both of which the now concentrated solution $B_C$, separated from the ice crystals, returns to the circulation tank 22 to be suitably diluted and recirculated.

The per se largely known refrigerant circuit includes a receiver vessel 12 in which collects the liquefied refrigerant $R_L$ coming from the condenser 10, a first pass through the liquid separator-heat exchanger 4, a first expansion valve 30, the evaporator section of the evaporator-crystallizer 2, a second expansion valve 32, the liquid separator-regenerative heat exchanger 4 where the refrigerant arrives as "wet" vapor, i.e., a liquid/vapor mixture $R_{L+V}$, from which the vapor component $R_V$, aspirated by the compressor 6, is forced via an oil separator 8 into the condenser 10. The liquid refrigerant $R_L$ yielded in the liquid separator-heat exchanger 4 is returned to the evaporator housing 34 of the evaporator-crystallizer 2. In the above first pass through the liquid separator-regenerative heat exchanger 4, the relatively cold refrigerant vapor $R_V$ absorbs heat from the liquid refrigerant $R_L$ and is thus superheated, while the liquid refrigerant $R_L$ is subcooled. Subcooling of $R_L$ upstream of the expansion valve 30 is advantageous, as it reduces throttling losses, thus increasing the specific cold capacity of the refrigerant.

Figure 2:
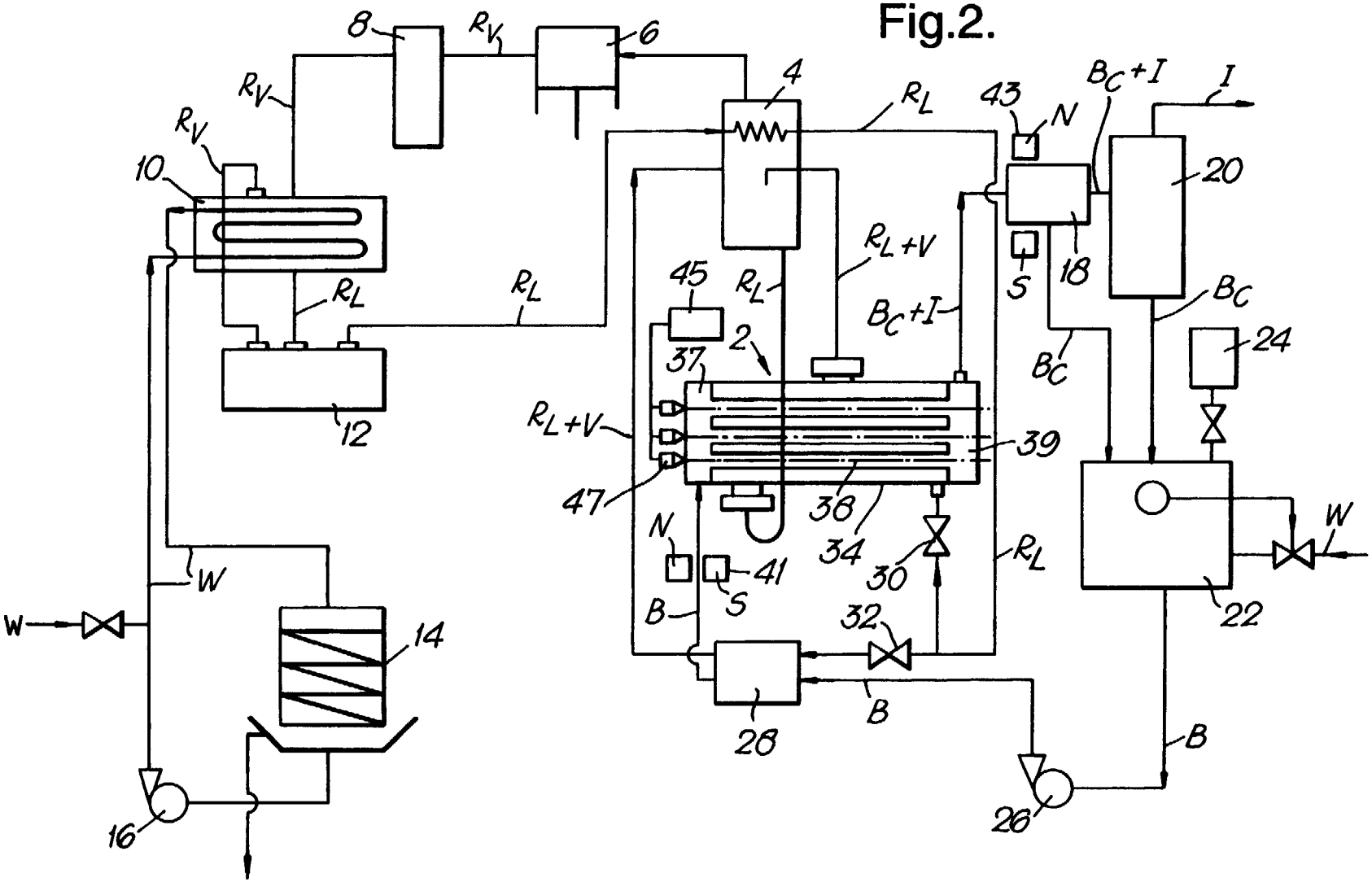
FIG. 2 is a general layout and flow diagram of a second embodiment of the installation according to the invention.

A further development of the invention, schematically illustrated in FIG. 2, utilizes the effect, on the solution, of magnetic fields as well as of ultrasound.

Ferromagnetic particles, always present in treated water in various quantities, have a certain influence on the processes of crystallization and coagulation. These iron admixtures come in different forms such as ions, colloids and large dispersed particles, all of which may play a ferromagnetic, as well as a paramagnetic role, and their availability increases the saturation intensity of the solution, which, in turn, promotes acceleration of the crystal-forming process by increasing the number of viable nuclei. This effect of the magnetic field is, however, not perceived unless the magnetic field strength exceeds 5 $10^3$ A/m.

Location of the magnet (or, rather, electromagnet) producing the magnetic field should be as close as possible to the point where crystallization is to take place, since the "magnetic memory" which carries the effect is apt to deteriorate unless the freshly "magnetized" solution is processed without delay. This is the reason why one magnet 41 is located a short distance upstream of the inlet manifold 37, and a second magnet 43 is disposed where it affects the crystal growth vessel 18.

Another positive effect is the reduction of metal corrosion.

It has been further found that application of ultrasound to the solution in the tubular elements 38 has a beneficial effect on both the detachment of crystal nuclei from the inner wall surfaces of the tubular elements 38 and on the enhancement of crystal nuclei formation within the elements. This is due to the fact that at a certain point in the growth of ice nuclei, resonance is established between the frequency of their free oscillations and the frequency of the ultrasound waves, at which instant the oscillation amplitude of the crystals sharply increases, loosening their attachment to the wall. If the ultrasound source is of a high intensity, particle acceleration becomes very high and cavitation phenomena appear, which result in very high accelerations that produce forces higher than the adhesive forces between the crystal nuclei and the wall surface by factors of between 10 to 100. Cavitation sets in at sound intensities of at least 2 W/cm$^2$ and frequencies of 15 kHz.

Best results are obtained by combining the magnetic treatment and the ultrasonic treatment. Such a combined treatment is capable of increasing pure ice crystal output by a factor of 1.5–2.

FIG. 2 shows the ultrasound generator 45 and the acoustic transducers 47, one for each tubular element 38.

Figure 4:
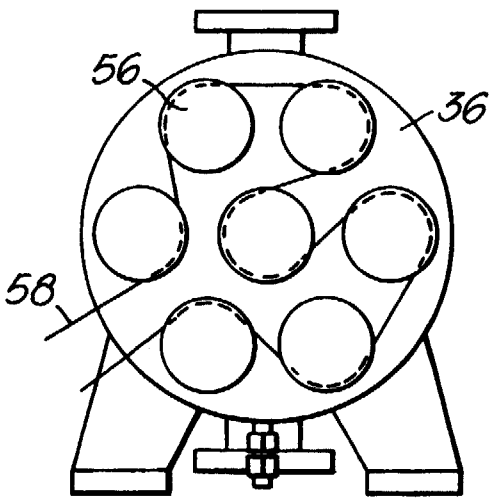
FIG. 4 is a lateral view of the evaporator-crystallizer of FIG. 1.

A first embodiment of a practical realization of the evaporator-crystallizer 2 according to the invention is illustrated in FIGS. 3 to 5.

There is seen a cylindrical, substantially horizontally disposed evaporator housing 34 with two end plates 36 in which are fixedly mounted a plurality of, in this particular case, seven, tubular elements 38 with smooth internal wall surfaces, which elements are to be filled with solution in which ice crystals are to be formed by refrigeration. Of these seven elements 38, FIG. 3, for reasons of clarity, shows only the central one. Not shown, for the same reason, are the inlet manifold 37 and the outlet manifold 39 schematically indicated in FIG. 1.

Figure 5A:
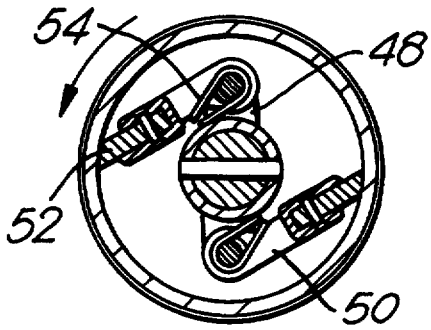
Figure 5B:
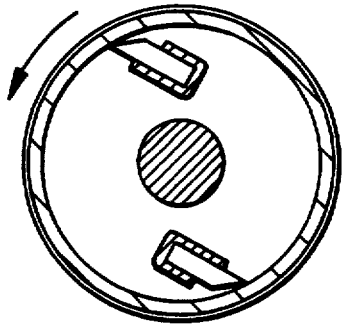
Figure 5C:
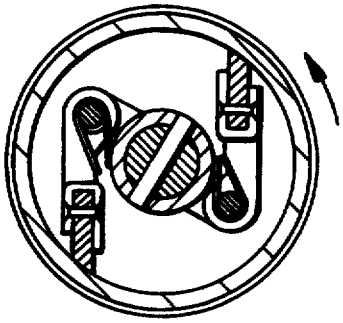
Figure 5D:
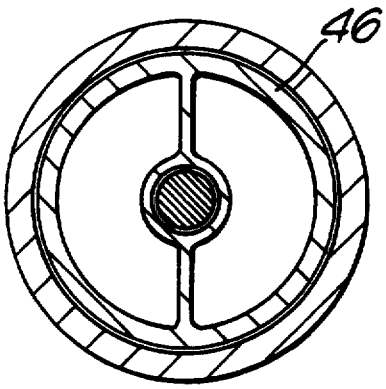

To one end of each of the elements 38 is fixedly connected a head 40 including ball bearings 42 in which is mounted a shaft 44, the other end of which is supported by the central portion of a mounting element 46 (FIG. 5*d*). To the shaft 44 are pinned lug pairs 48 to which are articulated, by means of levers 50 (FIG. 5*a*), pairs of teflon blades 52 continuously pressed against the wall of the tubular element 38 by means of torsion springs 54. In the embodiment shown, there are three units of such blade pairs, angularly offset with respect to one another and slightly overlapping in longitudinal extent, as clearly seen in FIGS. 5*a*, 5*b* and 5*c*.

Belt pulleys 56 are keyed to the end of each shaft 44 and are advantageously driven by a single belt 58 slung around all the pulleys as indicated in FIG. 4. The speed of the electric motor (not shown) that drives the belt 58 is preferably adjustable. Obviously, rotation of the shafts 44 could also be effected by gear transmissions, or by a combination of belt and gear transmissions.

The rotating blades 52 prevent the aggregation of ice crystals at the walls of the refrigerated elements 38 not so much by their direct shear action upon rotation, but principally by the scouring effect of the wave front produced in the solution B by, and leading, the rapidly rotating blades 52.

The solution B, adjusted to a concentration of 10°-20° Brix, is introduced into the tubular elements 38 through inlet sockets 60 by the pump 26 (FIG. 1) and leaves the elements 38 as solution-and-ice mixture $B_C+I$ through the outlet socket 62 to which is attached a duct 64 leading eventually to the crystal growth vessel 18 (FIG. 1).

Liquid refrigerant $R_L$ coming via an expansion valve 30 (FIG. 1) from the receiver vessel 12 is introduced into the cylindrical housing 34 through the inlet socket 66 and leaves it as a mixture of liquid and vapor $R_{L+V}$ through the outlet socket 68 on top of the housing. A second inlet socket 70 at the bottom of the housing serves to return to the housing 34 the liquid refrigerant $R_L$ precipitated in the liquid separator-heat exchanger 4 (FIG. 1).

In order to reduce the adhesive force between the inner wall surface of the cooled elements 38 and the ice crystals, or rather the ice crystal nuclei, forming on that wall, the latter is ground and polished to a surface quality of about $3\times10^{-5}$ m and/or provided with a "non-stick" coating. The outer wall surface, that is, the surface that is in contact with the boiling refrigerant, is advantageously roughened to increase its effective heat transfer area. Methods to this end are well-known in the art, and include also the provision of a porous coat of a thickness of between 0.1 and 1 mm.

The installation using the above-explained evaporator-crystallizer 2 can be modified with the magnetic fields and ultrasound transducers as indicated in FIG. 2.

While in the arrangement illustrated in FIG. 2 the ultrasonic vibrations are propagated through the liquid medium, i.e., the solution, it is also possible to use some of the evaporator-crystallizer's structural elements for this purpose. Thus, as shown in FIG. 3 in dash-dotted lines, an ultrasound transducer 71 can be attached to the shaft 44 by means of a coupling member 73 and induces the shaft 44 and all structural members in direct contact with it to perform ultrasonic vibrations. The mode of vibration (longitudinal, transverse or torsional) is a function of the design and mounting method of the particular transducer used. Not shown are the slip rings obviously needed to connect the rotating transducers to the stationary power supply.

A different arrangement is seen in FIG. 8. There, the shaft 44 is hollow, as clearly seen in FIG. 8a and accommodates transducers 71 the axes of which are perpendicular to the axis of shaft 44. Concentrators 49 transmit the ultrasonic energy to strip-like surfaces 51 attached to the concentrators 49 and rotating together with the shaft 44, a small clearance separating these surfaces from the inner wall surface of the tubular element 38 which is thus irradiated across this clearance, causing the ice crystal nuclei to be detached from the wall.

Figure 9:
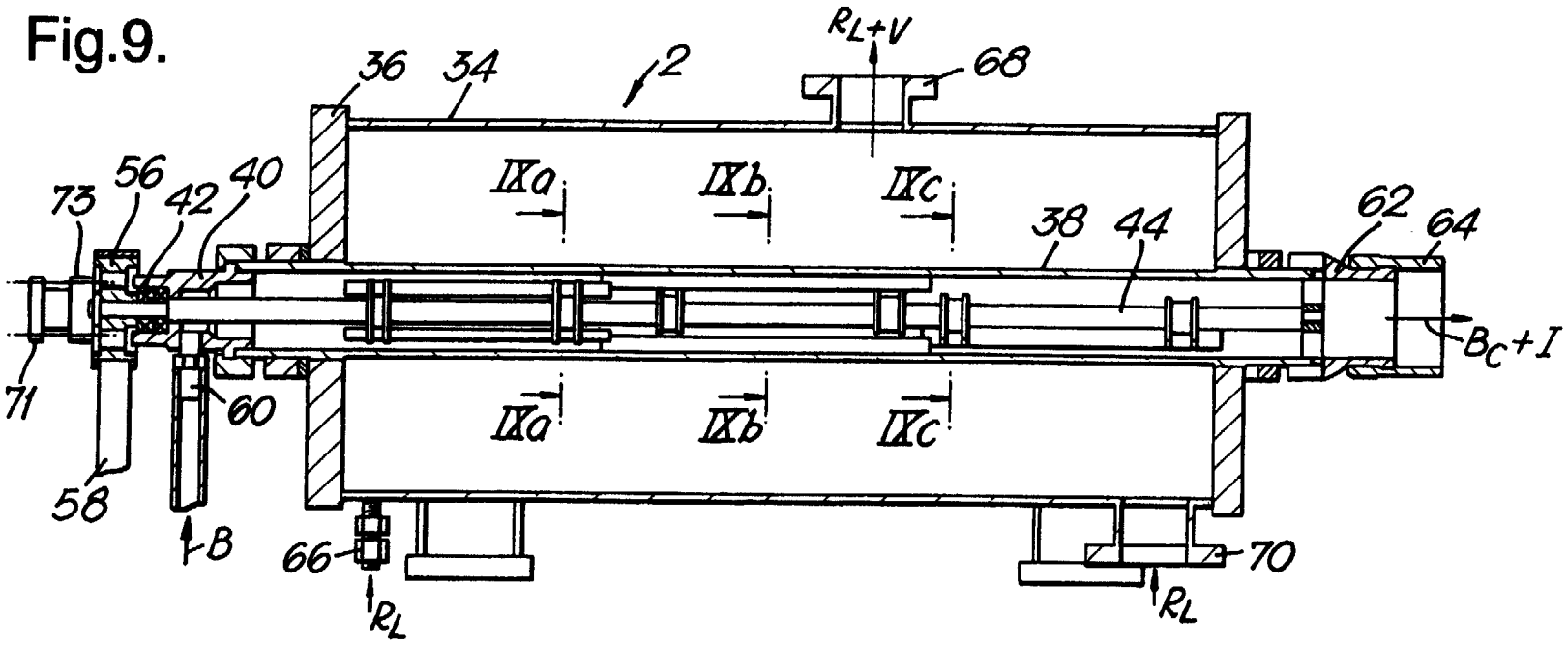
Figure 9C:
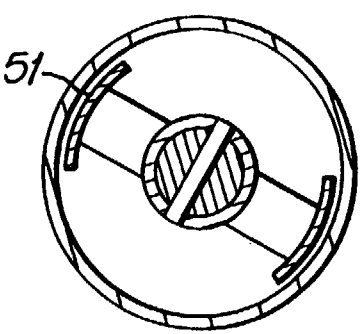
Figure 9B:
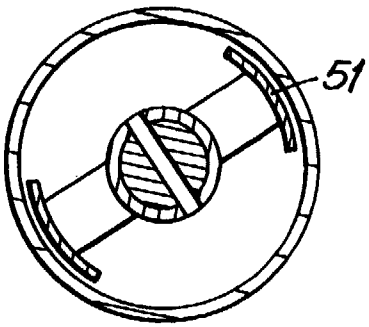
Figure 9A:
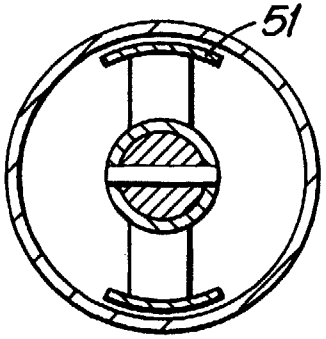

The embodiment shown in FIG. 9 combines some features of the embodiments of FIGS. 3 and 8: The ultrasound transducer, 71 is attached to the shaft 44 as in FIG. 3, and the ultrasonic vibrations are transmitted to strip-like surfaces 51 which act as radiators to the above-explained effect.

The evaporator-crystallizer 2 of FIGS. 6, 7 is of a design similar to that of FIGS. 3-5, except that it is vertically disposed and carries a horizontally disposed liquid separator-regenerative heat exchanger 4. To provide room for the head 40 and the drive pulleys 56, the evaporator-crystallizer 2 is mounted on legs 72. Another difference resides in the fact that the mixture of liquid and vaporous refrigerant $R_{L+V}$ leaves the evaporator housing 34 for the liquid separator-regenerative heat exchanger 4 through large-diameter pipes 74, with the liquid refrigerant $R_L$, precipitated in the liquid separator-heat exchanger 4, returning to the evaporator housing 34 through the very same pipes 74. The vaporous refrigerant $R_V$ leaves the heat exchanger 4 for the compressor 6 (FIG. 1) through the pipe socket 76. The refrigerant and solution circuits are the same as shown in FIG. 1, and the installation can also be modified with the magnetic fields and ultrasound transducers as indicated in FIG. 2.

The characteristic feature of the vertical evaporator-crystallizer is the intensive formation of foam upon the refrigerant boiling off, especially if the refrigerant is freon. This foam formation, when stabilized, greatly enhances heat exchange between the refrigerant and the solution. However, the foam rises and enters the liquid separator and must be prevented from reaching the compressor 6 (FIG. 1). This is effected by the heat exchanger coil 78, which carries the liquid refrigerant $R_L$ from the receiver 12 (FIG. 1). The coil 78 is of a relatively high temperature and when the foam comes into contact with the coil surfaces, it disintegrates. Otherwise the function of the liquid separator-heat exchanger 4 of this embodiment is exactly the same as that described earlier.

In the embodiment illustrated in FIG. 10, detachment of the crystal nuclei and the small ice crystals from the walls of the tubular elements 38 is based on the principle of the use of inertial forces that produce an elastic deformation of these elements, which in turn causes the nuclei and crystals to be pried off the wall surfaces.

There is seen in FIG. 10 an evaporator-crystallizer 2 of a prismatic shape in which are arranged an array of vertically disposed tubular elements 38. These elements are not of a circular but, advantageously, of an elongated cross-section, shown here with their narrow sides facing the viewer. At one of their ends these elements open into an inlet manifold 37, at the other of their ends, into an outlet manifold 39. Solution B at the predetermined concentration is introduced into the inlet manifold 37 via the inlet socket 60 and leaves the tubular elements 38 as the mixture $B_C+I$ in the outlet manifold 39. Liquid refrigerant $R_L$ enters the evaporator housing 34 via the inlet socket 66 and leaves as $R_{L+V}$ for the liquid separator-regenerative heat exchanger 4 (not shown) via the fork-like, two-way arrangement 74 seen also in FIG. 6, through which the separated liquid refrigerant $R_F$ is also returned to the evaporator.

Attached to, but thermally insulated from, the evaporator-crystallizer 2, there is seen an ice separator 20 with an outlet socket 80 for the concentrated solution $B_C$ which is led back to the circulation tank 22. Part of the bottom of the outlet manifold 39 that covers the ice separator 20 is designed as a strainer 82, so that when, in a manner to be explained further below, the mixture $B_C+I$ (concentrated solution+liquid ice) moves across the strainer 82 on its way to the consumer, the concentrated solution $B_C$ drops into the separator 20 and is drained off via the socket 80.

The entire above-described separator-evaporator unit 20/2 is mounted on elastic constraints, in this case two pairs of flat springs 84 (of which one of each pair is visible). The upper end of each spring is fixedly attached to the unit, the lower end to a reactive mass, a rigid yoke 86 which, in its turn, is mounted on a massive base 88 with the aid of flat springs 90.

A mechanical "shaker" arrangement 92 is mounted on the base 88 and comprises a motor-driven crank disk 94 with a crank pin 95, having an advantageously adjustable eccentricity, to which is articulated a connecting rod 96, the other end of which is hingedly attached to one of the upright portions of the yoke 86. The ends of both upright portions carry elastomer buffers 98 and 100, respectively, and the end walls of the separator-evaporator unit 20/2 are provided with counterbuffers 102, 103 of such dimensions as to provide (advantageously adjustable) gaps 104 between buffers 98, 100 and counterbuffers 102, 103.

When the shaker 92 is switched on, the yoke 86 starts to perform forced oscillations, the frequency of which depends on the speed of the crank disk 94 and the amplitude of which is a function of the eccentricity of the crank pin 95. These forced oscillations of the yoke 86, because of the elastic coupling constituted by the flat springs 84, induce oscillations also in the separator-evaporator unit 20/2. In the course of these twofold oscillations, the buffers 98 and 100 and their respective counterbuffers 102 and 103 will alternatingly collide, producing decelerations as well as accelerations of a considerable magnitude which cause the tubular elements 38 to undergo elastic deformations, producing inertial forces that are 10 to 15 times larger than the adhesion forces binding the ice crystal nuclei to the inside wall surfaces of the tubular elements.

The ice nuclei and crystals having thus been detached from the inner wall surface of the tubular elements 38, now move to the top of the elements due to their buoyancy and enter the outlet manifold 39, where they encounter another effect of the shaker arrangement: by choosing for the left buffer 100 an elastomer of greater rigidity than that of the right buffer 98, deceleration of the unit 20/2 upon collision between buffer 100 and counterbuffer 102 will be much sharper than deceleration upon collision between buffer 98 and counterbuffer 103. The inertial "slopping" movement of the ice nuclei and crystal slush in the outlet manifold 39 is thereby biased by a force component acting towards the left, thus moving the mass step-by-step across the strainer 82 (where it loses its concentrated solution $B_C$) towards the outlet socket 106, where it becomes available to the consumer as pure ice.

Obviously, all conduits leading to, or coming from, the vibrating unit 20/2 must be flexible to accommodate the oscillatory movement.

Another embodiment using vibrations as a means to prevent adhesion of the nuclei and small ice crystals to the inside wall surfaces of the tubular elements is illustrated in FIG. 11.

This embodiment provides vibrators 108 which, via concentrators 110, cause the tubular elements 38 to be elastically deformed. The vibrators 108 are controlled by an interrupter-distributor 112 which actuates the vibrators 108 cyclically between periods substantially equal to the time required for the formation of ice crystals of a predetermined size. The pulses can be applied simultaneously, sequentially or at shifted phases. The crystals, detached by the vibrations, are transported by the solution flow and carried towards the outlet socket 62. From this point on, this embodiment follows the layout of FIG. 1.

The vibrators 108 can be of various types such as electromagnetic, piezoelectrical, magnetostrictional, etc. The two unattached arrows at the interrupter-distributor 112 are meant to indicate additional lines for feeding additional vibrators 108.

Still another embodiment employing vibrations is shown in FIG. 12. Attached to the inlet ends of the tubular elements 38 there are seen heads 114, each containing a ball 116 supported, in the state of rest of the device, by a plate 118 provided with a number of peripheral holes 120.

In operation, the vibrational effect is produced in the following manner: The hydraulic interruper-distributcr 112 cyclically sends pulses of solution into the tubular elements 38 via the perforated plates 118 in the heads 114. Due to the pulsating flow, the ball 116 is caused to perform a turbulent motion, in the course of which it violently collides with both the plate 118 and the wall of the head 114. The loosening of the adhering nuclei and crystals is effected by the interaction of the vibrations produced in the tubular elements by the ball 116 periodically impacting the heads 114, and the pulsating flow of solution through the tubular elements 38 which produces acute pressure fluctuations in these elements.

This embodiment, too, fits into the layout of FIG. 1.

All embodiments can be provided with the magnet arrangement shown in FIG. 2 and described in detail. However, only the embodiments of FIGS. 3, 6 and 8 are also suitable for application of the ultrasound attachment shown in FIG. 2.

Apart from the stated object of this invention, it can also be used for desalination of sea water, for concentration of liquid solution and suspensions such as juice, beer, wine, etc., in air-conditioning, storage of perishables, fish and poultry processing, pharmaceutics, waster water treatment, etc.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A method for continuous production of liquid ice, comprising the steps of:

providing a solution of a predetermined concentration, having a below-zero cryoscopic temperature;

withdrawing said solution from a circulation tank and passing it through at least one tubular element, the outer wall surface of which is in direct thermal contact with a boiling refrigerant in an evaporator-crystallizer, heat exchange with which refrigerant, across the wall of said tubular element, causes the solution layer adjacent to the inside surface of said tubular element to cool down and to produce ice crystal nuclei adhering to said inside surface;

leading liquid-particles-containing refrigerant vapor produced by said boiling refrigerant from said evaporator-crystallizer to a liquid separator and returning the liquid refrigerant thus separated to said evaporator-crystallizer;

applying means to remove said ice crystal nuclei from said inside surface and to distribute them as well as said wall-adjacent cooled-down solution layer substantially uniformly throughout the entire volume of said tubular element to promote formation of ice crystal nuclei and of small, pure ice crystals throughout said volume;

removing said nuclei and said pure ice crystals together with concentrated solution from said tubular element;

separating said ice crystals from said concentrated solution, and returning said concentrated solution to said circulation tank and restoring the concentration thereof to its predetermined value.

2. A method for continuous production of liquid ice, comprising the steps of:

providing a solution of a predetermined concentration, having a below-zero cryoscopic temperature;

providing means for generating at least one magnetic field;

withdrawing said solution from a circulation tank;

leading said solution through said at least one magnetic field;

passing said solution, acted upon by said magnetic field, through at least one tubular element, the outer wall surface of which is in direct contact with a boiling refrigerant in an evaporator-crystallizer, heat exchange with which refrigerant, across the wall of said tubular element, causes the solution layer adjacent to the inside surface of said tubular element to produce ice crystal nuclei adhering to said inside surface;

applying means to remove said ice crystal nuclei from said inside surface and to distribute them, as well as said wall-adjacent, cooled-down solution layer, substantially uniformly throughout the entire volume of said tubular element to promote formation of ice crystal nuclei and of small, pure ice crystals throughout said volume;

removing said nuclei and said pure ice crystals together with concentrated solution from said tubular element;

separating said ice crystals from said concentrated solution, and returning said concentrated solution to said circulation tank and restoring the concentration thereof to its predetermined value.

3. The method as claimed in claim 1 or 2, comprising the further step of precooling said solution, after withdrawing same from said circulation tank and prior to the passing of same through said tubular element.

4. The method as claimed in claim 1 or 2, comprising the further step of causing said ice crystal nuclei and said small ice crystals as removed from said at least one tubular element to grow to a utilizable size before separating them from said concentrated solution.

5. The method as claimed in claim 2, wherein a second magnetic field is provided for said solution to pass through after its removal, together with said ice crystal nuclei and small pure ice crystals, from said at least one tubular element.

6. The method as claimed in claim 1 or 2, comprising the further step of exposing said cooled solution inside said tubular elements to irradiation by ultrasound.

7. The method as claimed in claim 1 or 2, wherein removing, from said inside surface, of said ice nuclei and said wall-adjacent solution layer is effected by producing a solution wave front that sweeps said surface and deflects said nuclei and said solution layer towards the inside of said at least one tubular element.

8. The method as claimed in claim 1 or 2, wherein removing, from said inside surface, of said ice nuclei and said wall-adjacent solution layer is effected by subjecting said at least one tubular element to vibration-induced elastic deformations.

9. An installation for continuous production of liquid ice from a solution, comprising:

a circulation tank for supplying solution of a predetermined concentration and receiving solution at a different concentration, to be made up to said predetermined concentration;

pump means for propelling solution from said circulation tank into at least one tubular element in heat-conductive contact, in an evaporator-crystallizer, with a boiling refrigerant;

a refrigeration circuit for cooling solution passing through said at least one tubular element, causing the formation therein of ice crystal nuclei and small pure ice crystals;

a liquid separator-regenerative heat exchanger mounted above said evaporator-crystallizer;

conduit means interconnecting said liquid separator and said evaporator-crystallizer;

a crystal growth vessel into which said cooled solution containing ice crystal nuclei and small ice crystals is discharged via a conduit, in which vessel ice crystals of utilizable size are created adiabatically by the elimination of small particles and from which vessel any crystal-free, concentrated solution is led back via another conduit to said circulation tank, and an ice separator fed from said ice crystal growth vessel, in which pure ice crystals are separated from concentrated solution which is returned to said circulation tank via a further conduit, said pure ice crystals being continuously discharged from said ice separator.

10. An installation for continuous production of liquid ice from a solution, comprising:

a circulation tank for supplying solution of a predetermined concentration and receiving solution at a different concentration, to be made up to said predetermined concentration;

pump means for propelling solution from said circulation tank into at least one tubular element in heat-conductive contact, in an evaporator-crystallizer with a boiling refrigerant;

a heat exchanger located downstream of said pump means and upstream of said at least one tubular element, in which heat exchanger said solution is precooled by giving up heat to said refrigerant before being introduced into said at least one tubular element;

a refrigeration circuit for cooling solution passing through said at least one tubular element, causing the formation therein of ice crystal nuclei and small pure ice crystals;

a liquid separator-regenerative heat exchanger mounted above said evaporator-crystallizer and serving to superheat the refrigerant vapor produced by the boiling-off liquid refrigerant in said evaporator-crystallizer, and to subcool said liquid refrigerant, further serving to separate the mixture of liquid and vaporous refrigerant exiting from said precooling heat exchanger to provide dry vaporous refrigerant for said refrigerant circuit;

conduit means interconnecting said liquid separator and said evaporator-crystallizer to return said separated liquid refrigerant to said evaporator-crystallizer;

a crystal growth vessel into which said cooled solution containing ice crystal nuclei and small ice crystals is discharged via a conduit, in which vessel ice crystals of utilizable size are created adiabatically by the elimination of small particles and from which vessel any crystal-free, concentrated solution is led back via another conduit to said circulation tank, and an ice separator fed from said ice crystal growth vessel, in which pure ice crystals are separated from concentrated solution which is returned to said circulation tank via a further conduit, said pure ice crystals being continuously discharged from said ice separator.

11. The installation as claimed in claim 9 or 10, further comprising means for generating at least one magnetic field to act on said solution prior to its introduction into said at least one tubular element in order to enhance and accelerate crystal formation.

12. The installation as claimed in claim 9 or 10, wherein at least one second magnetic field is generated, designed to act on the contents of said crystal growth vessel.

13. The installation as claimed in claim 9 or 10, further comprising an ultrasound generator and at least one ultrasound transducer acoustically coupled with said solution in said at least one tubular element, in order to facilitate detachment of the crystallized layer at said inner wall surface and to enhance mixing of the entire solution volume in said tubular element.

14. The installation as claimed in claim 9 or 10, wherein said evaporator-crystallizer is substantially horizontally disposed.

15. The installation as claimed in claim 9 or 10, wherein said evaporator-crystallizer is substantially vertically disposed and said liquid separator-regenerative heat exchanger is substantially horizontally disposed.

16. The installation as claimed in claim 9 or 10, wherein there is provided a plurality of said tubular elements, the inside wall surface of which is given a high-quality finish or a non-stick coating, and the outside surface of which is roughened.

17. The installation as claimed in claim 9 or 10, wherein the outside surface of said tubular elements is provided with a porous coating.

18. The installation as claimed in claim 9 or 10, wherein said means for removing said ice crystal nuclei are a plurality of rotating blades mounted on shafts inside said plurality of tubular elements, each shaft having a drive pulley, all pulleys being driven by a single drive belt.

19. The installation as claimed in claim 18, further comprising an ultrasound generator and at least one ultrasound transducer coupled with at least one of said shafts and producing ultrasonic vibrations therein.

20. The installation as claimed in claim 19, wherein said at least one shaft is hollow, accommodating said transducer, and the axis of said at least one transducer is perpendicular to the axis of said at least one shaft.

21. The installation as claimed in claim 19, further comprising a plurality of strip-like surfaces attached to, and rotating together with, said at least one shaft and acting as radiators of ultrasonic energy produced by said at least one transducer.

22. The installation as claimed in claim 9 or 10, wherein said means for removing said ice crystal nuclei are a plurality of vibrators controlled by an interrupter-distributor feeding said vibrators cyclically at a period substantially equal to the time required for the formation of ice crystals of a predetermined size, said vibrators, when actuated, causing said tubular elements to be elastically deformed.

23. The installation as claimed in claim 9 or 10, wherein said means for removing said ice crystal nuclei are a plurality of heads attached to the inlet ends of said tubular elements, each head containing a ball supported, in the state of rest, on a perforated plate, a hydraulic interrupter-distributor periodically sending pulses of solution into said tubular elements via said perforated plates, causing said ball to perform a turbulent motion, thereby violently colliding with said plate and the wall of said head, thus producing in said tubular elements periodic vibrations and pressure fluctuations instrumental in the removing of said ice crystal nuclei from said walls.

* * * * *